US005624145A

United States Patent [19]

Swilley

[11] Patent Number: 5,624,145

[45] Date of Patent: Apr. 29, 1997

[54] PLASTERING MATERIAL SCOOP APPARATUS

[75] Inventor: Anthony T. Swilley, Talmadge, Ohio

[73] Assignee: Premier Plastering, Inc., Akron, Ohio

[21] Appl. No.: 564,993

[22] Filed: Nov. 30, 1995

[51] Int. Cl.[6] ..... A47L 17/06

[52] U.S. Cl. ..... 294/55; 15/236.07

[58] Field of Search ..... 294/1.1, 3.5, 26.5, 294/49, 51, 53.5, 55; 15/105, 235.4, 235.7, 236.01, 236.05, 236.07; 30/124, 169, 171, 324; 172/13, 371, 380, 381

[56] References Cited

U.S. PATENT DOCUMENTS

| | | | |
|---|---|---|---|
| 467,831 | 1/1892 | Reynolds | 294/49 X |
| 789,258 | 5/1905 | Connolly | 294/49 |
| 937,754 | 10/1909 | Bartels | 294/55 X |
| 2,572,230 | 10/1951 | Williams | 294/55 X |
| 3,608,944 | 9/1971 | Turner | 294/55 X |
| 4,355,432 | 10/1982 | Storm | 15/236.07 X |
| 4,477,972 | 10/1984 | Testa | 294/49 X |
| 4,627,128 | 12/1986 | Shea | 294/55 X |

*Primary Examiner*—Johnny D. Cherry
*Attorney, Agent, or Firm*—Benesch, Friedlander, Coplan & Aronoff

[57] ABSTRACT

A plastering tool particularly suited for removing plastering material from large pails for transfer to a plastering hawk tool includes a rigid cylindrical handle portion. A scoop is fixed to a first distal end of the handle portion. The scoop has a planar base portion shaped as to form a generally acute angle. Disposed on the base portion opposite the acute angle and generally concentric therewith is a sidewall that is substantially perpendicular to the base. The sidewall is rounded on opposite sides thereof. The scoop is fixed symmetrically to the handle. With the afore-noted structure, the plastering tool is particularly suited for removal of plaster from shipment containers for transfer thereof to plastering hawking tools or the like.

6 Claims, 1 Drawing Sheet

PLASTERING MATERIAL SCOOP APPARATUS

BACKGROUND OF THE INVENTION

The subject application pertains to the art of plastering or stucco application and will be described with particular reference thereto. However, it will be appreciated that the invention is applicable to any application involving the handling of similar consistency as the stucco of the preferred embodiment.

In the synthetic stucco industry, material typically comes prepackaged in relatively large containers, such as five gallon pails. Professionals that will work with or apply these materials first remove a portion from the bulk containers prior to working. Heretofore, tradesmen, such as plasterers, have been relegated to use such makeshift tools that might be fabricated from portions of cut bleach or milk containers. Such makeshift tools would be used for removing materials from the bulk containers and providing them to working tools, such as the afore-noted plaster hawking tool.

Such earlier tools, while somewhat functional, left much to be desired from the functionality and usability from the tradesman's perspective. The subject of design overcomes the above-problems, and others, and teaches the structure of an improved stucco or material handling tool that is easy and efficient to use and lessens spillage associated therewith.

SUMMARY OF THE INVENTION

In accordance with the present invention, there is provided a plastering tool which includes a rigid, generally cylindrical handle portion. A scoop is fixed to one end of the handle. The scoop itself includes a generally planar base portion which is formed as an acute angle, a vertex of which is rounded. A rounded side wall is disposed generally symmetrically about a longitudinal axis of the handle portion. A rounded side wall is disposed generally perpendicularly to the base portion of the scoop.

An advantage of the present invention is the provision of a plastering tool which allows for ease in removal of plastering material from bulk containers.

Another advantage of the present invention is the provision of a plastering tool which minimizes loss and spillage associated with its use.

Yet a further advantage of the subject invention is the provision of a plastering tool which is sufficiently shaped and weighted to minimize user fatigue while still allowing for full access to relatively deep bulk containers.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment and method of which will be described in detail in this specification and illustrated in the accompanying drawings which form a part hereof, and wherein.

DETAILED DESCRIPTION OF THE PREFERRED EMBODIMENT

Figure 1:
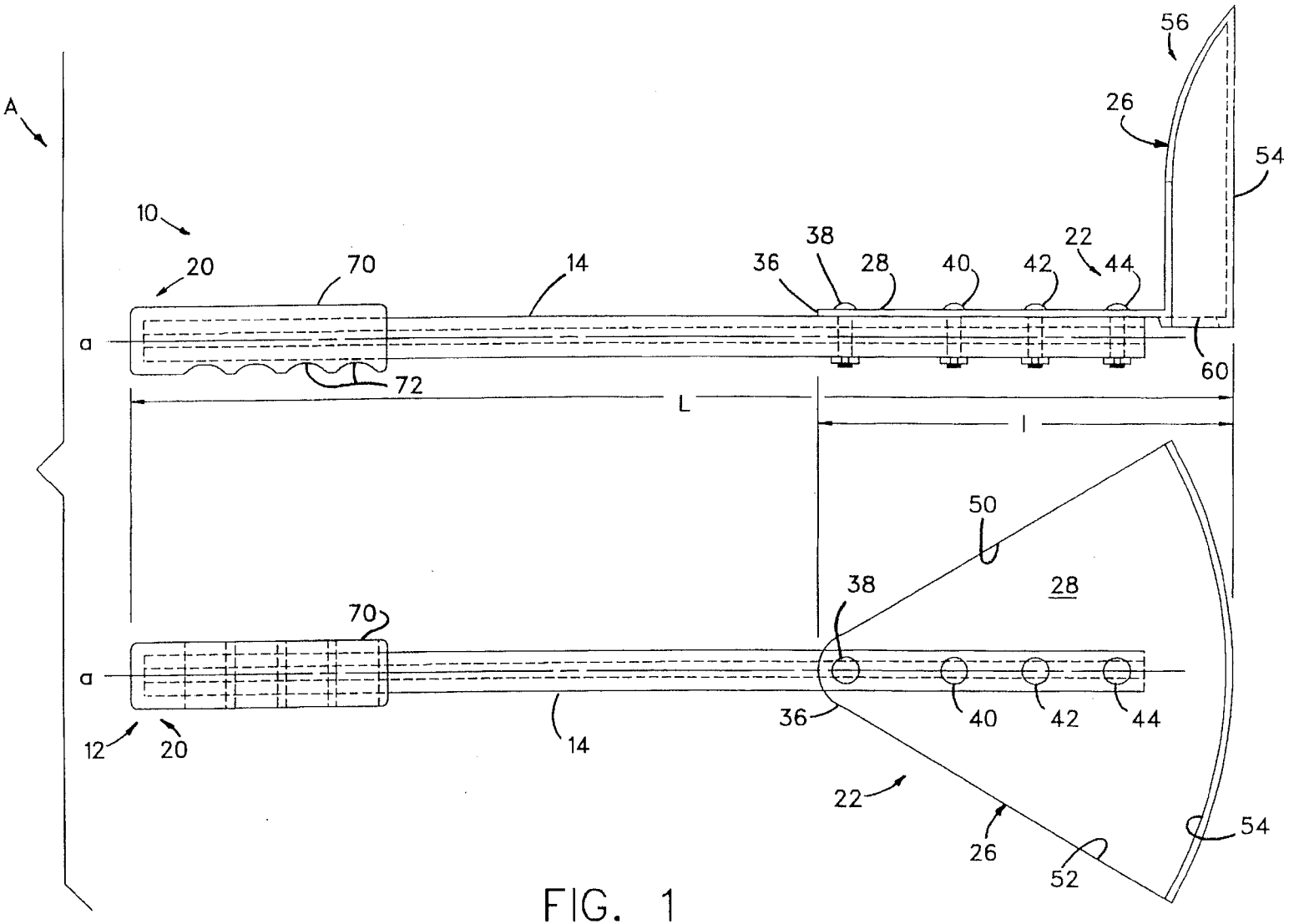
FIG. 1 illustrates top and side views of the plastering tool of the subject invention.

Referring now to the drawing wherein the showing is for the purposes of illustrating the preferred embodiment of the invention only and not for purposes of limiting same, FIG. 1 illustrates a plastering tool A, and more particularly a side view 10 and a plan or top view 12 thereof. The tool is particularly well suited for the removal of a section of the contents of plaster handling bins, such as the five gallon bins typically encountered in the industry. A rigid, generally cylindrical handle portion 14 is suitably comprised from a substantially rigid material, such as plastic or polyvinylchloride ("PVC"). In the preferred embodiment, the handle portion 14 is generally cylindrical and has first and second opposed, spaced apart ends 20 and 22. In the preferred embodiment, the handle portion 14 is formed from a generally rigid plastic or polyvinylchloride ("PVC") tube.

Disposed at a first end 22 of handle portion 14 is a scoop 26. In the preferred embodiment, the scoop 26 is also comprised of a plastic or PVC material which is ideally somewhat more resilient than that associated with the handle portion 14. Scoop 26 includes a generally planar base portion 28 having a length "l" which is generally parallel to a longitudinal axis a of the handle portion 14. The handle portion 14 has a length "L". Preferably the length "L" of the handle portion 14 is three times the length "l" of the base portion.

The planar base portion 28 has an acute angle or vertex portion 36 being rounded so as to be generally radially disposed from a first fastener 38.

A fastener 38, as well as fasteners 40, 42 function to rigidly secure the base portion 28 with the handle portion 14. As illustrated, each fastener 38, 40, 42, and 44 is comprised of nut and bolt combinations. However, it will be appreciated that other suitable fasteners, such as rivets may be employed. Additionally, insofar as the subject preferred embodiment has both the base portion 28 and the handle portion 14 comprised of PVC materials, it will also be appreciated that plastic cement may be suitably substituted to anchor the two together. As will be appreciated from the illustration of FIG. 1, the vertex 36 defines first and second radial walls 50 and 52, respectively. The radial walls 50 and 52 terminate at a sidewall 54 which is generally perpendicular to the base portion 28. Sidewall 54 is also arcuate, having a center point thereof being radially inwardly directed to the point 38. The longitudinal axis "a" is disposed along a radius of curvature that extends from the vertex of the walls 50 and 52, through the point 38, and to the sidewall 54. The scoop 26, as well as all subportions thereof, is disposed generally symmetrically about the longitudinal axis a of the handle portion 14.

The sidewall 54 in the preferred embodiment is also rounded perpendicularly to the base portion 28 by the area 56. It will be appreciated that such rounding occurs from a radius that advantageously includes an apex on the sidewall 54 that is perpendicular to the longitudinal axis a and extending to each of the opposed ends of the sidewall 54, directed generally to the radial walls 50 and 52, respectively.

The scoop 26 also has a structurally supportive rib portion 60 which is an extension of sidewall 54 to an opposite part of the base portion 28. The ribbed portion 60 functions to add rigidity and strength to the entire scoop 26.

Also optionally provided on the handle portion 14, on a second end thereof, is a molded handle portion 70 which suitably includes a plurality of recessed finger areas 72 such that it functions as a grip.

With the foregoing construction, there is provided a plastering tool which allows for easy and efficient removal of material from bulk plaster storage containers, or the like.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is now claimed:

1. A plastering tool comprising:

a rigid, elongated generally cylindrical handle portion having first and second spaced apart opposite ends thereon, the handle portion generally extending along a longitudinal axis;

a scoop fixed to the first of the spaced apart ends, the scoop including, a generally planar base portion having a first radial wall and a second radial wall that intersect at a vertex end such that the base portion has an acute angle at the vertex end, the vertex end of the base portion being rounded in a generally circular circumferential portion, and a rounded side wall, is disposed at generally a right angle to the base portion coincident to and at an arc end of the base portion, the arc end located radially opposite the vertex end, the handle portion is disposed along a radius of curvature from the vertex end to the arc end; and whereas the scoop is fixed generally symmetrically to the handle portion such that the scoop is substantially symmetrical to the longitudinal axis;

the base portion is generally parallel to the longitudinal axis; and the vertex end is disposed toward the second spaced apart end of the handle portion.

2. The plastering tool of claim 1 wherein the rounded side wall has first and second opposed, rounded portions disposed generally perpendicular to the base portion.

3. The plastering tool of claim 2 wherein the handle portion, taken along its longitudinal axis, is at least three times a length of the base portion.

4. The plastering tool of claim 3 wherein the scoop and the handle portion are comprised of plastic.

5. The plastering tool of claim 4 wherein the scoop is fixed to the handle portion with a plurality of metal fasteners.

6. The plastering tool of claim 5 further comprising a molded grip portion fixed to the second end.

* * * * *